US012133604B2

(12) United States Patent
Courtney

(10) Patent No.: US 12,133,604 B2
(45) Date of Patent: Nov. 5, 2024

(54) SECURED RECEPTACLE FOR DELIVERY PACKAGES

(71) Applicant: Gerald Courtney, Langhorne, PA (US)

(72) Inventor: Gerald Courtney, Langhorne, PA (US)

( * ) Notice: Subject to any disclaimer, the term of this patent is extended or adjusted under 35 U.S.C. 154(b) by 104 days.

(21) Appl. No.: 17/932,931

(22) Filed: Sep. 16, 2022

(65) Prior Publication Data

US 2024/0090693 A1 Mar. 21, 2024

(51) Int. Cl.
*A47G 29/14* (2006.01)

(52) U.S. Cl.
CPC ..... *A47G 29/141* (2013.01); *A47G 2029/144* (2013.01); *A47G 2029/145* (2013.01)

(58) Field of Classification Search
CPC ..... A47G 29/20; A47G 29/22; A47G 29/141; A47G 2029/144; A47G 2029/145; B65D 55/14
See application file for complete search history.

(56) References Cited

U.S. PATENT DOCUMENTS

| | | | | |
|---|---|---|---|---|
| 5,624,071 | A | 4/1997 | Sosan | |
| 6,155,715 | A | 12/2000 | Lake et al. | |
| 9,364,112 | B2 | 6/2016 | Sundaresan | |
| 9,656,115 | B2 | 5/2017 | Young | |
| 9,926,108 | B2 | 3/2018 | Wiley et al. | |
| 10,076,204 | B1 * | 9/2018 | Sadeghi | A47G 29/141 |
| 10,282,951 | B1 * | 5/2019 | Kulick | A47G 29/141 |
| 10,321,780 | B1 * | 6/2019 | James | A47G 29/141 |
| 10,383,471 | B1 * | 8/2019 | Barnes | A47G 29/124 |
| 10,653,261 | B2 * | 5/2020 | Loures | E05B 67/383 |
| 10,682,002 | B2 * | 6/2020 | Miller | A47G 29/20 |
| 10,743,694 | B2 * | 8/2020 | Raphael | A47G 29/141 |
| 10,842,305 | B1 * | 11/2020 | Alcolea | A47G 29/20 |
| 10,869,570 | B2 * | 12/2020 | Dunkelberger | A44B 19/30 |
| 11,253,096 | B2 * | 2/2022 | Bartley-Clark | A47G 29/30 |
| 11,406,212 | B2 * | 8/2022 | Odeh | A47G 29/141 |
| 11,412,876 | B1 * | 8/2022 | Kadlub | A47G 29/20 |
| 11,510,517 | B2 * | 11/2022 | McLean | B65D 11/1853 |
| 11,766,147 | B2 * | 9/2023 | Benevento | A47G 29/124 232/19 |
| 11,889,937 | B2 * | 2/2024 | Meddah | G08B 3/1016 |
| 11,896,150 | B2 * | 2/2024 | Chiappetta | A47G 29/20 |
| 2011/0284707 | A1 | 11/2011 | Adams et al. | |
| 2012/0269461 | A1 | 10/2012 | Proctor et al. | |
| 2017/0127868 | A1 * | 5/2017 | Adewuyi | A47G 29/22 |
| 2018/0202199 | A1 | 7/2018 | Critz | |
| 2018/0228311 | A1 * | 8/2018 | Bloom | A47G 29/20 |

(Continued)

FOREIGN PATENT DOCUMENTS

| | | | | |
|---|---|---|---|---|
| CA | 2220810 | A1 * | 5/1999 | A47G 29/20 |

*Primary Examiner* — William L Miller
(74) *Attorney, Agent, or Firm* — LaMorte & Associates P.C.

(57) ABSTRACT

A system and method for receiving and securing a package that is delivered to a location. A bag receptacle is provided at the door. A locking assembly engages the bag receptacle. The locking assembly can hold the bag receptacle in an open configuration and can retain and lock the bag receptacle in a closed configuration. Strapping is used to connect the locking assembly to the outside surface of a door. The strapping encircles the door. A power module is supported by the strapping on the inside surface of the door, where it can be accessed with the door closed.

16 Claims, 4 Drawing Sheets

(56) References Cited

U.S. PATENT DOCUMENTS

| | | | | |
|---|---|---|---|---|
| 2019/0133362 | A1 | 5/2019 | Gilligan | |
| 2019/0223644 | A1 | 7/2019 | Hopp | |
| 2019/0246828 | A1 | 8/2019 | Miller | |
| 2019/0350398 | A1* | 11/2019 | Raphael | A47G 29/141 |
| 2020/0015617 | A1* | 1/2020 | Izquierdo Gonzalez | G06Q 10/0832 |
| 2020/0060460 | A1* | 2/2020 | Farrar | A47G 29/141 |
| 2020/0093310 | A1 | 3/2020 | Hauck | |
| 2021/0127880 | A1* | 5/2021 | Raphael | A47G 29/141 |
| 2022/0183491 | A1* | 6/2022 | Cooper | A47G 29/20 |
| 2022/0395124 | A1* | 12/2022 | Meddah | G08B 13/1463 |
| 2023/0029102 | A1* | 1/2023 | de Jonge | A47G 29/141 |
| 2023/0157472 | A1* | 5/2023 | Barkman | A47G 29/20 232/1 R |
| 2023/0322456 | A1* | 10/2023 | Parks | B65D 55/14 220/210 |
| 2023/0329469 | A1* | 10/2023 | Alvarez Garcia | A47G 29/20 |

* cited by examiner

SECURED RECEPTACLE FOR DELIVERY PACKAGES

BACKGROUND OF THE INVENTION

1. Field of the Invention

In general, the present invention relates to devices that are used to secure packages that are delivered to the door of a building and are then left unattended. More particularly, the present invention relates to devices that anchor to the door of a building, or other stationary object, and prevent theft of any package or other item secured within the device.

2. Prior Art Description

Many services deliver packages to homes and businesses. If the package does not require a confirmatory signature, then the delivery driver typically leaves the package at the front door of the home or office. The person who ordered the package is then informed of the delivery using some electronic format, such as an email or text. If there is no one at the building to retrieve the package, then the package is vulnerable to theft. Any person walking or driving past the building can see the package at the door. It takes only seconds for a person to run to the front door, steal the package, and retreat. In law enforcement, people who steal packages in such a manner are referred to as porch pirates.

As the delivery of packages becomes more prevalent in society, so has package theft. Accordingly, there have been many inventions directed toward securing packages left by couriers. Lock boxes have been used to secure packages. The lock boxes are mounted to the floor or wall near the front door of a building. Lock boxes typically have openings that can accept a package but prevent any item in the box from being accessed. The problem with lock boxes is that they must be larger than the largest package they can accept. Accordingly, lock boxes tend to be bulky and occupy a significant amount of space. Such lock boxes are exemplified by U.S. Patent Application Publication No. 2020/0093310 to Hauck. Many buildings have very little space available around the door. This is especially true if the door leads directly to stairs. Accordingly, the use of a large lock box can block access to the door and/or create a tripping hazard on or near stairs.

Recognizing the problems associated with lock boxes, bags have been used to accept packages. The bags can be folded when not in use and are far less cumbersome than are boxes. The bags attach to a door or a doorknob using a tether. Such prior art bags are exemplified by U.S. Pat. No. 6,155,715 to Lake et al. A problem associated with such systems is that the bag can be stolen with the package simply by cutting the tether with a pair of wire cutters. Furthermore, tethers are hard to see, and the tethers can create tripping hazards near and around the door. This is especially true if a person is exiting the door and is unaware of the presence of the tether on the outside of the door.

To eliminate the use of a tether, but still use a flexible bag, bags have been strapped directly to doors. Such prior art devices are exemplified by U.S. Pat. No. 5,624,071 to Sosan and U.S. Patent Application Publication No. 2019/0246828 to Miller. A problem associated with these devices is that they are strapped to either the top edge of the door or the bottom edge of the door. Attachment to the bottom edge of the door is impractical because it presents a tripping hazard, and the security device can prevent the door from opening and closing freely. Accordingly, many prior art devices attach to the top edge of a door. The problem with this location is that many doors have glass windows or panels on their upper halves. Packages can be heavy and/or can have salient points. If the package is suspended in front of the glass, then the package can strike the glass, This can occur when the door is opened or closed, or when the bag is affected by weather. The result is that a package can easily damage the door.

A need therefore exists for a security system for packages that does not use a tether, does not inhibit access to a door, and cannot damage a door. These needs are met by the present invention as described and claimed below.

SUMMARY OF THE INVENTION

The present invention is a system and method for receiving and securing a package that is delivered to a location. A bag receptacle is provided at the door. The bag receptacle has an opening for accessing the interior of the bag receptacle. The bag receptacle can receive a package when in an open configuration and can close around a package when in a closed configuration.

A locking assembly is provided that engages the bag receptacle. The locking assembly can hold the bag receptacle in its open configuration and can retain and lock the bag receptacle in its closed configuration. Strapping is provided that extends horizontally from the locking assembly. The strapping is used to connect the locking assembly to the outside surface of a door or another accessible point. The strapping encircles the door by passing around the vertical edges of the door and across the inside surface of the door.

A power module is provided for powering the workings of the locking assembly. The power module is supported by the strapping on the inside surface of the door, where it can be accessed with the door closed.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention security device can be embodied in many ways, only one exemplary embodiment is illustrated. The exemplary embodiment is being shown for the purposes of explanation and description. The exemplary embodiment is selected in order to set forth one of the best modes contemplated for the invention. The illustrated embodiment, however, is merely exemplary and should not be considered as a limitation when interpreting the scope of the appended claims.

Figure 1:
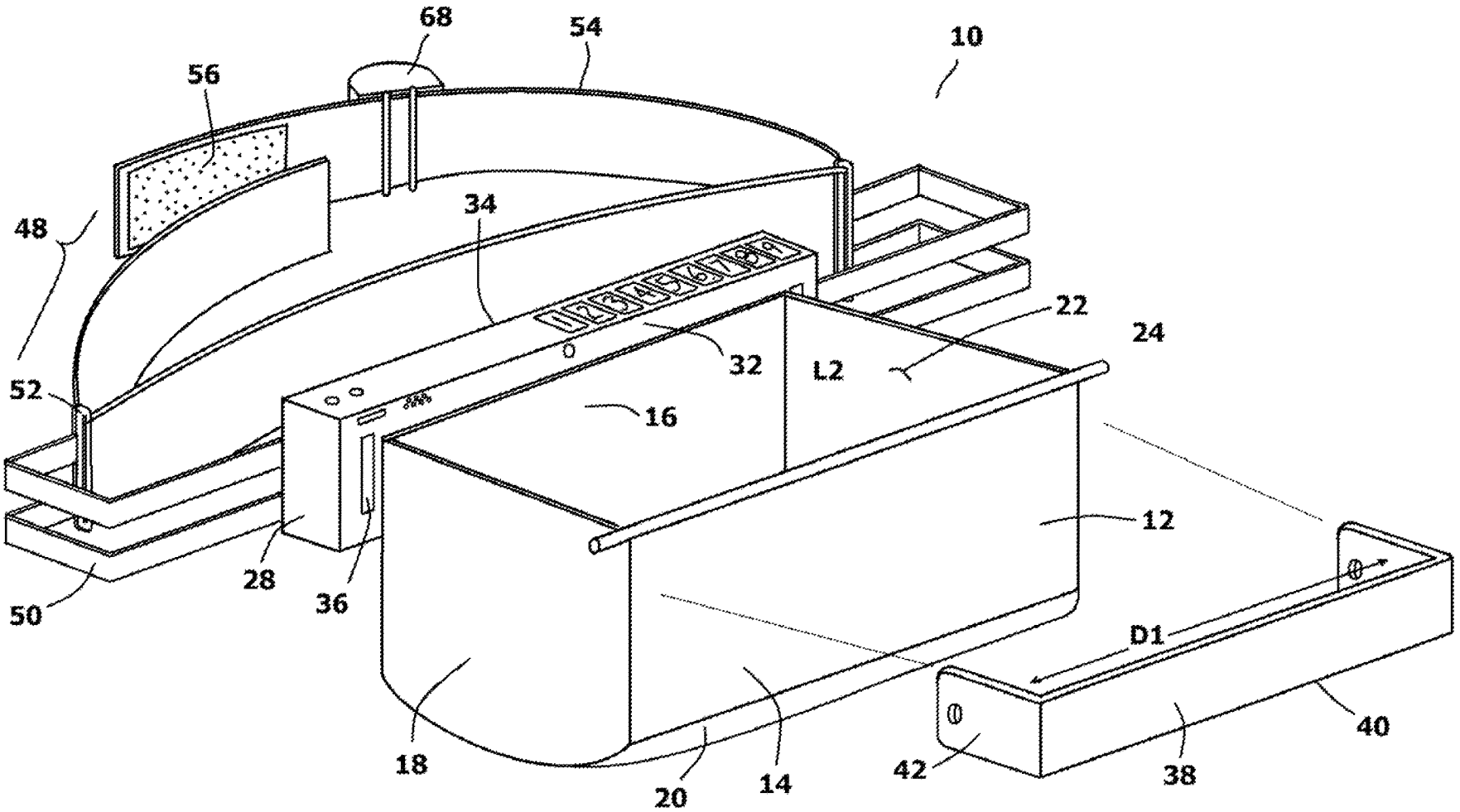
FIG. 1 is an exploded perspective view of an exemplary embodiment of a package security system.
Figure 2:
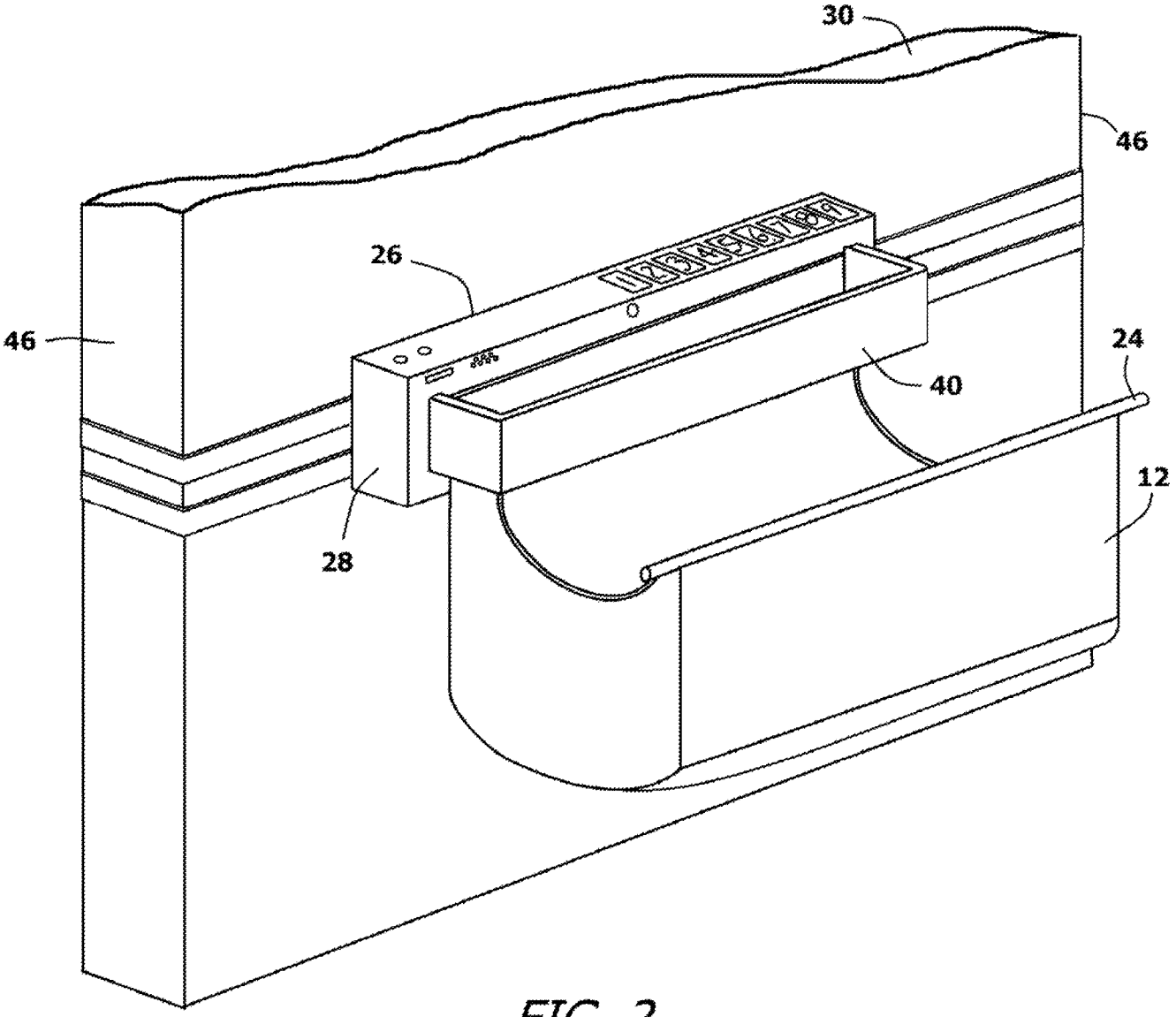
FIG. 2 is a perspective view of a package security system shown attached to a door with the flexible bag receptacle in an open configuration.
Figure 3:
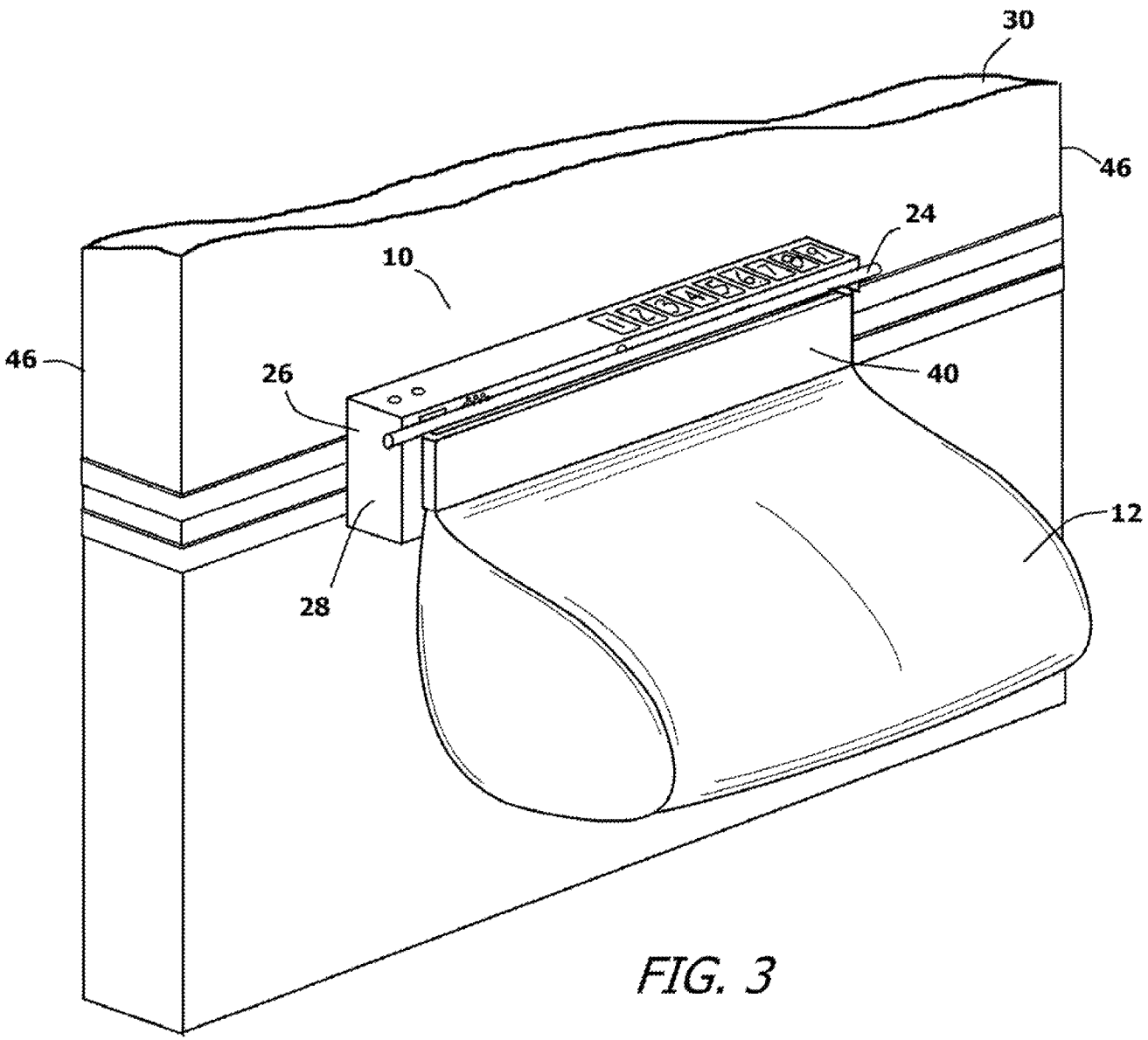
FIG. 3 is a perspective view of a package security system shown attached to a door with the flexible bag receptacle in a closed configuration.

Referring to FIG. 1 in conjunction with FIG. 2, and FIG. 3, the overall security system 10 is shown. The security system 10 contains a flexible bag receptacle 12. The flexible bag receptacle 12 has a front wall 14, a rear wall 16, two opposing side walls 18, a closed bottom surface 20 and an open top 22. The open top 22 can be selectively closed by moving the front wall 14 against the rear wall 16. The flexible bag receptacle 12 is preferably made of a flexible material, such as poly-praraphenylene terephthalamide (Kevlar®), chain mail, or wire reinforced polymers. Such materials are flexible and can be folded, yet are difficult to break or tear without specialized tools.

The flexible bag receptacle 12, when fully open, has a length L1. The flexible bag receptacle 12 is large enough to receive many common shipping boxes for consumer goods. A minimum volume for the flexible bag receptacle 12 is one cubic foot. A preferred maximum volume is between three cubic feet and six cubic feet.

The flexible bag receptacle 12 has a rigid bar 24 that is affixed to the top of the front wall 14. The rigid bar 24 is preferably a steel rod or a steel pipe that cannot be broken, cut, or bent without tools. The rigid bar 24 has a length L2 that is longer than the length L1 of the flexible bag receptacle 12. The purpose of the rigid bar 24 and the importance of its length L2 are later explained.

A locking assembly 26 is provided. The locking assembly 26 has a housing 28 that mounts to the front of a door 30 or another stationary object, such as a tree or post. The housing 28 has a front surface 32 and a rear surface 34. The rear surface 34 abuts against the door 30. The front surface 32 faces the flexible bag receptacle 12. Two slots 36 are formed in the front surface 32 of the housing 28. The slots 36 are sized and shaped to selectively receive and retain a metal bracket 40. The metal bracket 40 has a U-shape wherein a crossbar 38 spans between two side bars 42. The distance D1 between the side bars 42 is at least as wide as the length L1 of the flexible bag receptacle 12, but is smaller than the length L2 of the rigid bar 24. The side bars 42 pass through the slots 36 and into the housing 28 where they can be selectively retained or released by an internal electromechanical locking mechanism 44 (Shown in FIG. 4). When in a locked configuration, the crossbar 38 of the metal bracket 40 is held close to the front surface 32 of the housing 28. See FIG. 3. When in an unlocked configuration, the side bars 42 extend from the slots 36 and the metal bracket 40 extends away from the housing 28. See FIG. 2.

The rear wall 16 of the flexible bag receptacle 12 is affixed to the housing 28 of the locking assembly 26. When the metal bracket 40 is in an unlocked configuration (FIG. 2), the rigid bar 24 on the flexible bag receptacle 12 can be manually manipulated to be positioned inside or outside the metal bracket 40. When outside the metal bracket 40, such as in FIG. 2, the flexible bag receptacle 12 can be fully opened. Thus, packages can be placed into, or removed from, the flexible bag receptacle 12. Conversely, when the rigid bar 24 is positioned inside the metal bracket 40, the metal bracket 40 can be moved into its locked position. When the metal bracket 40 is locked, the front wall 14 of the flexible bag receptacle 12 is pressed against the rear wall 16 of the flexible bag receptacle 12. Accordingly, the open top 22 of the flexible bag receptacle 12 is closed and the contents of the flexible bag receptacle 12 are inaccessible. Furthermore, since the length L2 of the rigid bar 24 is longer than the distance D1 between the side bars 42 of the metal bracket 40, the rigid bar 24 cannot be pulled through the metal bracket 40. In this manner, the flexible bag receptacle 12 cannot be pulled open until the metal bracket 40 is moved to an open configuration.

The locking assembly 26 attaches to the door 30 of a building using a strapping system 48. The strapping system 48 includes tamper resistant straps 50 and an adjustable strap 54. The tamper resistant straps 50 extend laterally from the housing 28. The tamper resistant straps 50 are metal, Kevlar® or another material that is difficult to cut using a knife or box cutter. The tamper resistant straps 50 extend laterally around the long vertical edges 46 of the door 30. The tamper resistant straps 50 terminate with buckles 52. The buckles 52 are engaged by an adjustable strap 54 that can fold onto itself with hook and loop fastening material 56. In this manner, the overall length of the tamper resistant straps 50 and the adjustable strap 54 can be configured to fit around doors, trees, and posts of different widths and thicknesses.

Figure 4:
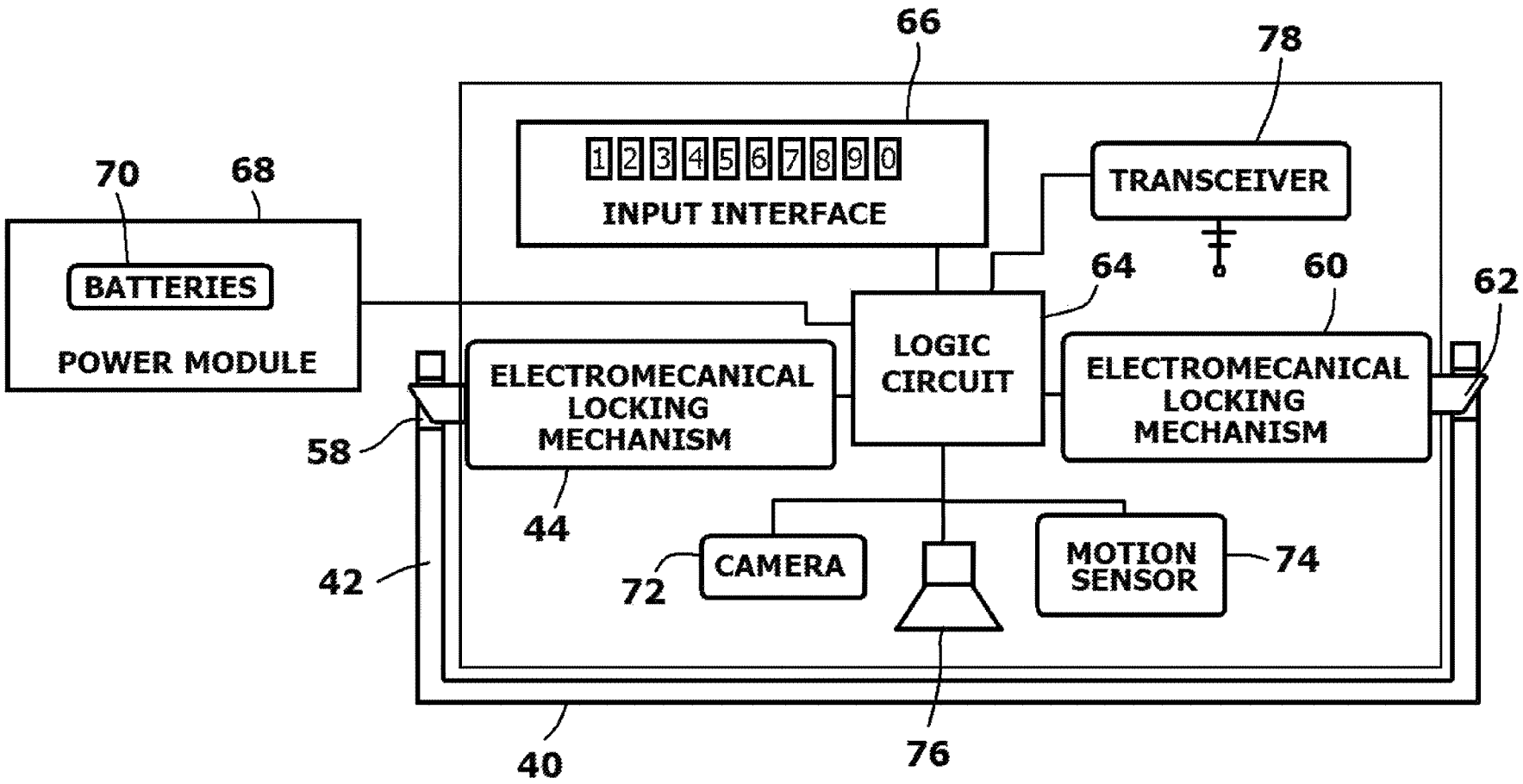
FIG. 4 shows a schematic of the primary electromechanical components within the exemplary package security system.

Referring to FIG. 4 in conjunction with FIG. 3, it will be understood that inside the housing 28 of the locking assembly 26, the electromechanical locking mechanism 44 engages locking holes 58 in the side bars 42 of the metal bracket 40. The electromechanical locking mechanism 44 that is illustrated utilizes a solenoid 60 extends a core rod 62 through the locking holes 58 in the side bars 42 of the metal bracket 40. When the solenoid 60 is energized, the core rod 62 retracts and the metal bracket 40 can be removed. It will be understood that the movements of the solenoid 60 can be replaced with a motor and cam system and that the use of a solenoid 60 is merely exemplary.

The operation of the electromechanical locking mechanism 44 is controlled by a logic circuit 64 and an input interface 66. The input interface 66 enables an access code to be entered and read by the logic circuit 64. The logic circuit 64 compares the code entered on the input interface 66 to an authorized code previously stored. If the codes match, the electromechanical locking mechanism 44 is activated.

The electromechanical locking mechanism 44 and the logic circuit 64 require electrical power. A power module 68 is provided that holds batteries 70. The batteries 70 are preferably rechargeable. The power module 68 is connected to the strapping system 48 and is located inside the door 30, while the flexible bag receptacle 12 is located outside the door 30. This prevents the batteries 70 from being removed by an unauthorized person. The inside location of the power module 68 also enables the batteries 70 to be connected to a charger without having to disconnect the security system 10 from the door 30.

Optional secondary electronics can be added to the security device 10. Such secondary devices include a camera 72 and a motion sensor 74 that trigger the camera 72. In this manner, the camera 72 can record each time a person approaches the security system 10. A speaker 76 can be provided that sounds a loud alarm, should the security system detect signs of tampering, such as the cutting of any tamper resistant strap 50. A transceiver 78 can also be provided. The transceiver 78 can be linked via Blutooth®, Wi-Fi, or cellular to a secondary device or to a data network. In this manner, images from the camera 72 can be viewed remotely. The transceiver 78 also allows authorized users to unlock the electromechanical locking mechanism 44 and have access to the flexible bag receptacle 12. In this manner, an authorized person, such as the homeowner, or an authorized courier, can have a code that unlocks the security system 10 so that a package can be placed in, or removed from, the flexible bag receptacle 12.

Referring now to all figures, it will be understood that to utilize the security system 10, a locking assembly 26 is placed flush against an exterior door 30 of a building. The strapping system 48 is used to hold the locking assembly 26 in place. The strapping system 48 extends around the door 30, passing fully around the door 30 and contacting the long vertical edges 46 of the door 30. The power module 68 is connected to the strapping system 48 and is located on the inside of the door 30 while the housing 28 of the locking assembly 26 is located on the outside of the door 30.

The security system 10 is initially left in an unlocked open configuration when a package delivery is expected. That is, the flexible bag receptacle 12 is fully open and its open top 22 is exposed in anticipation of receiving a package. When a delivery is made, the delivery driver places a package inside the flexible bag receptacle 12 on the outside of the door 30. The delivery driver then closes the flexible bag receptacle 12 behind the metal bracket 40 as the metal bracket 40 is pressed against the housing 28 of the locking assembly 26. Once the metal bracket 40 is pushed to a locked position, the electromechanical locking mechanism 44 locks the metal bracket 40 in place, therein locking the package within the flexible bag receptacle 12. An authorized user can enter the proper code into the input interface 66 to release the metal bracket 40. The flexible bag receptacle 12 can then be opened and any package removed.

It will be understood that the embodiment of the present invention that is illustrated and described is merely exemplary and that a person skilled in the art can make many variations to that embodiment. For instance, the length of the locking assembly 26 and the volume of the flexible bag receptacle 12 can vary in different production models. All such embodiments are intended to be included within the scope of the present invention as defined by the appended claims.

What is claimed is:

1. A system for receiving and securing a package, comprising:

a bag receptacle having an opening for accessing an interior of said bag receptacle, wherein said bag receptacle is configurable in a closed configuration and an open configuration, wherein said closed configuration said opening is closed and said interior of said bag receptacle is inaccessible, and wherein said open configuration said opening is open;

a locking assembly that engages said bag receptacle, wherein said locking assembly can hold said bag receptacle in said open configuration and retain and lock said bag receptacle in said closed configuration;

strapping that extends horizontally from said locking assembly for strapping said locking assembly to a secondary object; and a power module for powering said locking assembly, wherein said power module is outside said locking assembly and supported by said strapping.

2. The system according to claim 1, wherein said secondary object is a door having an inside surface, an outside surface, and vertical edges.

3. The system according to claim 2, wherein said strapping passes horizontally around said vertical edges of said door.

4. The system according to claim 3, wherein said strapping that passes over said outside surface of said door is metal.

5. The system according to claim 1, wherein said strapping is adjustable in length.

6. The system according to claim 1, wherein said locking assembly further includes secondary electronics selected from a group consisting of cameras, speakers, alarms, and data transceivers.

7. A system for receiving a package and securing said package to a door, wherein said door has an inside surface, an outside surface, and vertical edges, said system comprising:

a receptacle having a selectively closable opening;

an electromechanical lock that selectively locks said opening of said receptacle in a closed configuration;

strapping that extends from said lock and passes around said vertical edges of said door, wherein said strapping retains said electromechanical lock against said outside surface of said door; and a module supported by said strapping on said inside surface of said door, wherein said module powers said electromechanical lock.

8. The system according to claim 7, wherein said receptacle is a flexible bag having a volume of between one cubic foot and six cubic feet.

9. The system according to claim 8, wherein said flexible bag is made from material selected from a group consisting of poly-praraphenylene terephthalamide, metal mesh, chain mail and metal reinforced polymers.

10. The system according to claim 7, wherein said strapping is adjustable in length.

11. The system according to claim 7, further including secondary electronics selected from a group consisting of cameras, speakers, alarms, and data transceivers.

12. A method of securing a package to a door, wherein the door has an inside surface, an outside surface, and vertical edges, said method comprising:

providing a package receptacle that can be selectively opened and closed;

providing a lock that can lock said package receptacle closed, wherein said lock is electromechanical and said lock is powered by a power module; and strapping said lock to said outside surface of said door, wherein said strapping loops around said door passing around said vertical edges of said door and, wherein said power module is held by said strapping against said inside surface of said door.

13. The method according to claim 12, wherein said strapping has a length that is selectively adjustable.

14. The method according to claim 12, wherein said strapping is, at least in part, made of metal.

15. The method according to claim 12, wherein providing a package receptacle includes providing a flexible bag made from cut-resistant material.

16. The method according to claim 12, wherein providing a lock includes providing said lock with secondary electronics selected from a group consisting of cameras, speakers, alarms, and data transceivers.

* * * * *